US010199783B2

(12) United States Patent
Finn et al.

(10) Patent No.: US 10,199,783 B2
(45) Date of Patent: Feb. 5, 2019

(54) EXTENDABLE MODULAR POWER STRIP SYSTEM AND METHOD OF USE

(71) Applicant: Valiant Innovations, LLC, Kansas City, MO (US)

(72) Inventors: Michael F. Finn, Kansas City, MO (US); Adam B. Clay, Platte City, MO (US)

(73) Assignee: Valiant Innovations, LLC, Kansas City, MO (US)

( * ) Notice: Subject to any disclaimer, the term of this patent is extended or adjusted under 35 U.S.C. 154(b) by 0 days.

(21) Appl. No.: 15/688,420

(22) Filed: Aug. 28, 2017

(65) Prior Publication Data

US 2018/0062331 A1 Mar. 1, 2018

Related U.S. Application Data

(60) Provisional application No. 62/380,218, filed on Aug. 26, 2016.

(51) Int. Cl.

| | |
|---|---|
| ***H01R 13/514*** | (2006.01) |
| ***H01R 13/629*** | (2006.01) |
| ***H01R 13/70*** | (2006.01) |
| ***H01R 24/22*** | (2011.01) |
| ***H01R 24/60*** | (2011.01) |
| ***H01R 25/00*** | (2006.01) |
| *H01R 103/00* | (2006.01) |

(52) U.S. Cl.

CPC ..... *H01R 25/003* (2013.01); *H01R 13/514* (2013.01); *H01R 13/629* (2013.01); *H01R 24/22* (2013.01); *H01R 24/60* (2013.01); *H01R 13/70* (2013.01); *H01R 2103/00* (2013.01)

(58) Field of Classification Search

CPC .. H01R 25/003; H01R 13/514; H01R 13/629; H01R 24/22; H01R 24/60; H01R 31/02; H01R 31/06

See application file for complete search history.

(56) References Cited

U.S. PATENT DOCUMENTS 4,713,497 A * 12/1987 Smith ..... H02G 11/02 191/12.2 R
5,292,257 A 3/1994 Milan
5,562,488 A * 10/1996 Neiser ..... H01R 13/514 439/373
5,690,198 A * 11/1997 Lohr ..... H02G 11/02 191/12.2 R (Continued)

FOREIGN PATENT DOCUMENTS

CN 203871667 8/2014

*Primary Examiner* — Edwin A. Leon
*Assistant Examiner* — Oscar Jimenez
(74) *Attorney, Agent, or Firm* — Law Office of Mark Brown, LLC; Christopher M. DeBacker

(57) ABSTRACT

A flexible, extendable power strip with multiple modular components linked together along a flexible wire which allows each modular unit of the power strip to be placed remote from the next to power multiple devices from the same wall power outlet. The cord may retract within the modular units when the units are connected together by any suitable means. Power outlets may be on one or more faces of each of the modular units, and additional outlets including USB outlets may also be included in each modular unit.

12 Claims, 5 Drawing Sheets

(56) References Cited

U.S. PATENT DOCUMENTS 5,885,109 A * 3/1999 Lee ..... H01R 13/514 439/131
6,220,880 B1 * 4/2001 Lee ..... H01R 25/003 439/214
6,410,994 B1 6/2002 Jones et al.
6,573,617 B2 6/2003 Jones et al.
6,597,557 B2 * 7/2003 Hunter ..... A45C 3/02 361/118
7,229,302 B1 6/2007 Lai
7,309,834 B1 * 12/2007 Byrd ..... B65H 75/425 174/135
7,371,122 B2 5/2008 Ivanova et al.
7,488,204 B2 * 2/2009 Hsu ..... H01R 25/003 439/106
7,510,426 B2 * 3/2009 Hwang ..... H01R 13/60 191/12.4
7,607,928 B2 10/2009 Schriefer et al.
8,226,444 B2 7/2012 Chow
8,585,444 B2 11/2013 Chang
9,147,985 B1 9/2015 Noriega
9,276,366 B1 * 3/2016 Flores ..... H01R 24/66
2005/0090151 A1 * 4/2005 Laity ..... H01R 13/72 439/607.01
2007/0123108 A1 * 5/2007 Ivanova ..... H01R 9/2408 439/620.22
2011/0215759 A1 * 9/2011 Lee ..... G06F 1/266 320/115
2013/0115804 A1 * 5/2013 Vallon ..... H01R 13/72 439/501
2014/0120765 A1 * 5/2014 Lombardo ..... H01R 9/2408 439/501
2015/0111418 A1 * 4/2015 Vallon ..... H01R 13/72 439/501
2017/0199334 A1 * 7/2017 Wang ..... G02B 6/3817
2017/0302026 A1 * 10/2017 Tymus ..... H01R 13/6395
2017/0321853 A1 * 11/2017 Chien ..... H02J 7/0027

* cited by examiner

EXTENDABLE MODULAR POWER STRIP SYSTEM AND METHOD OF USE

CROSS-REFERENCE TO RELATED APPLICATION

This application claims priority in U.S. Provisional Patent Application No. 62/380,218 Filed Aug. 26, 2016, which is incorporated herein by reference.

BACKGROUND OF THE INVENTION

1. Field of the Invention

The present invention relates generally to an electrical power strip and method for use thereof, and more specifically to a modular, extendable electrical power strip.

2. Description of the Related Art

Power strips are extremely common. They are typically used to extend the distance from a wall power outlet for use with one or more electrical appliances or devices. Usual power strips have at least some capability for extension away from the wall, such as a long cord, but from there are limited to a single strip or bank of power outlets which themselves are locked into a limited distance away from the power outlet and the electrical devices. What is needed is a power strip device which can accommodate electrical devices in several locations while still requiring only a single wall outlet.

Heretofore there has not been available a system or method for a modular extendable power strip with the advantages and features of the present invention.

BRIEF SUMMARY OF THE INVENTION

The present invention generally provides a flexible, extendable power strip with multiple modular components linked together along a flexible wire which allows each modular unit of the power strip to be placed remote from the next to power multiple devices from the same wall power outlet. The cord may retract within the modular units when the units are connected together by any suitable means. Power outlets may be on one or more faces of each of the modular units, and additional outlets including USB outlets may also be included in each modular unit. The final modular unit 8 may include a power switch 24 for activating the power strip. The final modular unit 8 may also include a surge protector element (not shown).

An alternative embodiment may include a modular base which can receive additional modular outlet ports as needed. The base may include extendable elements such as the extendable cord indicated above, or may simply be a single platform for receiving additional modular elements.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Modular Extendable Power Strip 2

Figure 1:
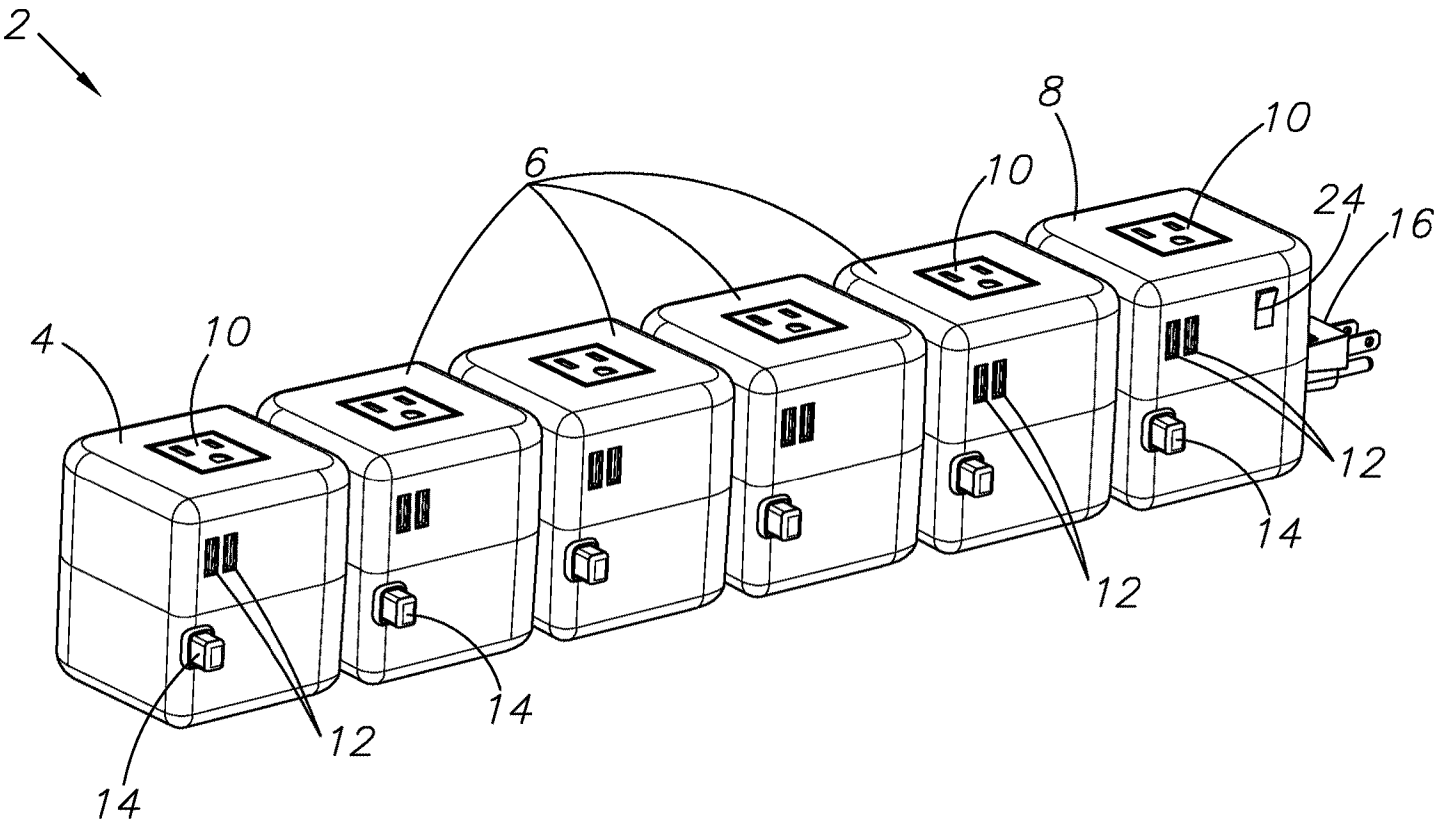
FIG. 1 is a three-dimensional isometric view of a preferred embodiment of the present invention shown in a first, compact orientation.
Figure 2:
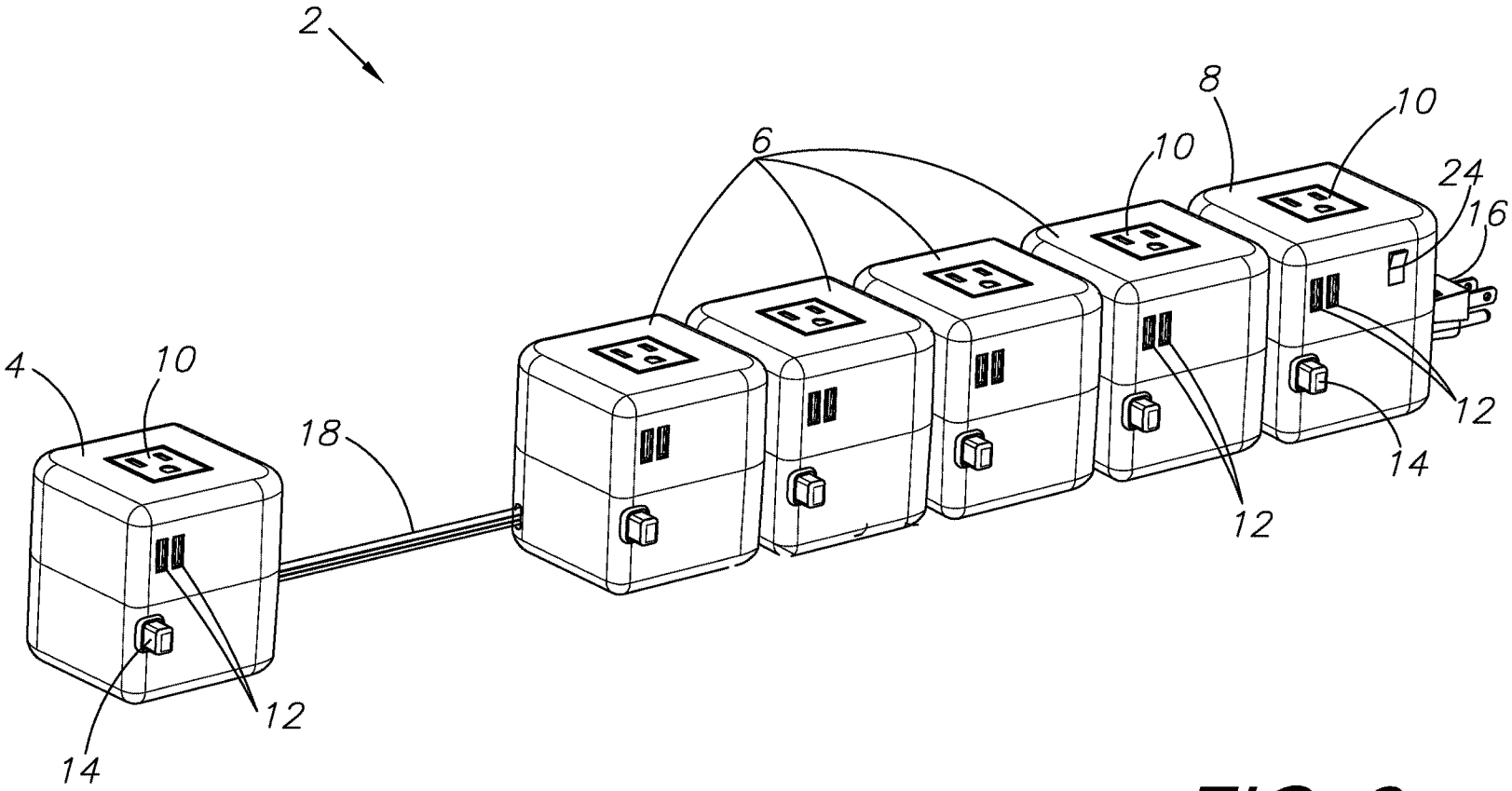
FIG. 2 is a three-dimensional isometric view of the embodiment thereof, shown in a second, partially extended orientation.
Figure 3:
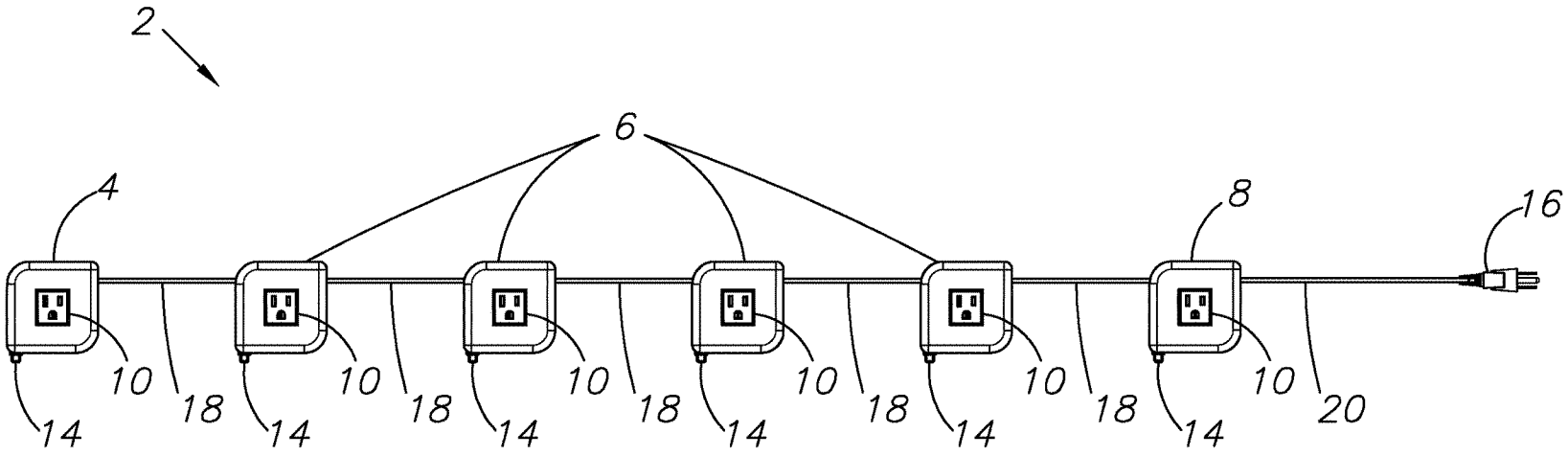
FIG. 3 is a top-plan view of the embodiment thereof, shown in a third, fully extended orientation.
Figure 4:
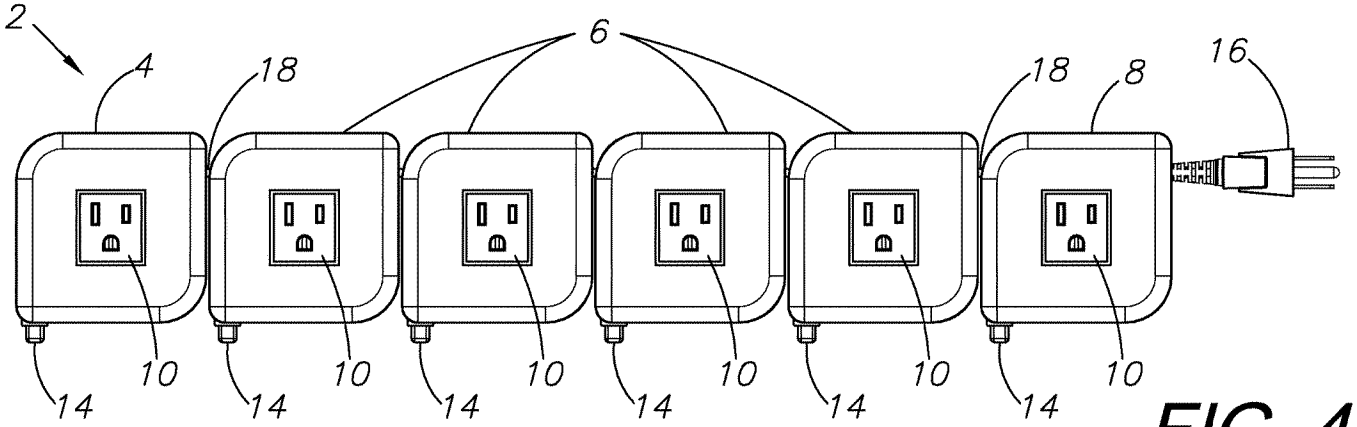
FIG. 4 is a top-plan view of the embodiment thereof, shown in the first, compact orientation of FIG. 1.
Figure 5:
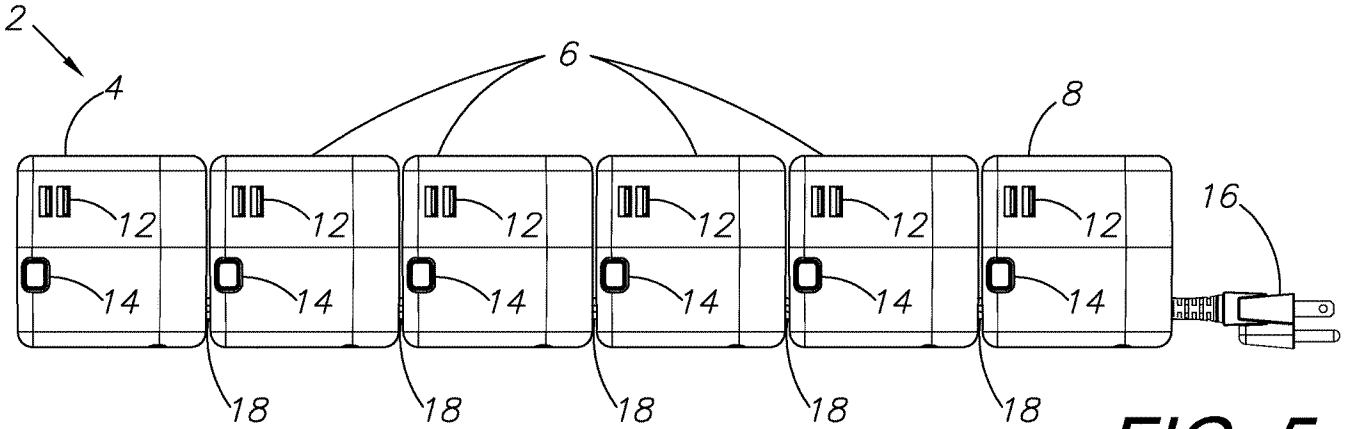
FIG. 5 is a front elevational view thereof.
Figure 6:
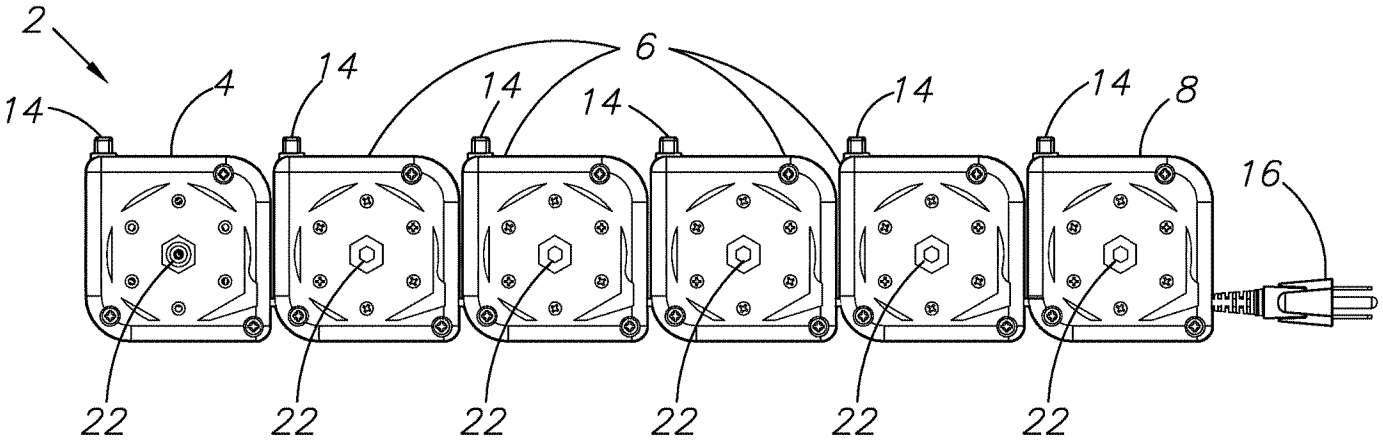
FIG. 6 is a bottom-plan view thereof.
Figure 7:
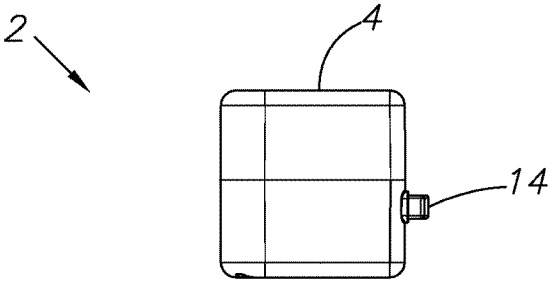
FIG. 7 is a left side elevational view thereof.

As shown in FIGS. 1-7, a modular, extendable power strip 2 generally includes multiple modular units 4, 6, 8 which are connected together via a flexible cord 18. The cord would be drawn into each respective modular unit when connected together in a compacted assembled state as shown in FIGS. 1 and 4-6, and each separate modular unit 4, 6, 8 would be allowed to extend out from the group of remaining units as they are separated and dispersed through a room containing devices requiring electrical power. Each face of each modular unit could conceivably have a power outlet 10, but at least one face of each unit should include at least one power outlet 10. As shown in the figures, a typical power outlet may also be coupled with a USB outlet 12.

The user connects the plug 16 to the wall outlet, thereby providing power to the strip 2. After this, the user can selectively disengage the modular units 4, 6, 8 from the strip as desired and spread them about an area requiring remote power connections. The final modular element 8 may include a power switch 24 for activating the entire strip. Alternatively, the individual switches 14 of each module could power each module individually. Those switches 14 could instead simply release the reel assembly 22 which includes a retractable spring mechanism, allowing the module 4, 6, 8 to be extended along with a portion of the cord 18. When connected, the extendable cord 18 either retracts into each modular element via the reel assembly 22 built into one face of each modular unit 4, 6, 8. Alternatively, the cord may simply be allowed to sit freely until the modular elements are disconnected and placed. The preferred embodiment consists of two or more plug receptacles that are separated by greater than two inches worth of flexible wire that can be retracted to connect the receptacles back into a firm strip.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A modular power strip system comprising:

a first power strip module having a first face comprising a first power outlet port and a second face having a second power outlet port;

a second power strip module having a first face comprising a first power outlet port and a second face having a second power outlet port;

a third power strip module having a first face comprising a first power outlet port and a second face having a second power outlet port;

said first, second, and third power strip modules each comprising a respective first, second and third portion of flexible electrical cable;

each of said first, second, and third power strip modules comprising a respective first, second, and third switch element;

each of said first, second, and third power strip modules comprising a respective first, second, and third reel configured for selectively reeling in and extending out said respective first, second, and third portions of flexible electrical cable;

wherein said first switch element of said first power strip module is configured to activate said first reel to reel in said first portion of flexible electrical cable;

wherein said second switch element of said second power strip module is configured to activate said second reel to reel in said second portion of flexible electrical cable;

wherein said third switch element of said third power strip module is configured to activate said third reel to reel in said third portion of flexible electrical cable; and whereby said first, second, and third power strip modules can be transformed from a first, closely-connected power strip assembly to a second, extended orientation whereby at least one of said first, second, and third power strip modules is placed in a location remote from at least one of said respective first, second, and third respective power strip modules.

2. The system of claim 1, wherein said first power strip module includes a power switch configured to activate power to said first power strip module, second power strip module, and third power strip module.

3. The system of claim 2, wherein said first power strip module further comprises a surge protector element.

4. The system of claim 1, further comprising:

wherein said first power outlet of said first power strip module comprises an American standard power outlet;

wherein said first power outlet of said second power strip module comprises an American standard power outlet; and wherein said first power outlet of said third power strip module comprises an American standard power outlet.

5. The system of claim 1, further comprising:

wherein said first power outlet of said first power strip module comprises a European standard power outlet;

wherein said first power outlet of said second power strip module comprises a European standard power outlet; and wherein said first power outlet of said third power strip module comprises a European standard power outlet.

6. The system of claim 1, further comprising:

wherein said second power outlet of said first power strip module comprises a universal serial bus (USB) outlet;

wherein said second power outlet of said second power strip module comprises a universal serial bus (USB) outlet; and wherein said second power outlet of said third power strip module comprises a universal serial bus (USB) outlet.

7. A method of deploying a power strip assembly, the method comprising the steps:

deploying a power strip assembly in a first, assembled orientation, said power strip assembly comprising a first power strip module having a first face comprising a first power outlet port, a second face having a second power outlet port, and a third face comprising a first reel switch, a second power strip module having a first face comprising a first power outlet port, a second face having a second power outlet port, and a third face comprising a second reel switch, and a third power strip module having a first face comprising a first power outlet port, a second face having a second power outlet port, and a third face comprising a third reel switch, each of said first, second, and third power strip modules connected by a respective first, second, and third portion of flexible cord wound into a respective spring-powered reel of each respective power module;

extending said first power strip module away from said second power strip module by extending said flexible cord out from said first power strip module and placing said first power strip module into a first position;

extending said second power strip module away from said third power strip module by extending said flexible cord out from said second power strip module and placing said second power strip module into a second position;

placing said third power strip module in a third position;

activating said power strip assembly by plugging a power plug into an electrical outlet and pressing a switch located on said first power strip module;

pressing said second reel switch, thereby activating the respective spring-powered reel of said second power module and retracting said second portion of flexible cord, thereby retracting said second power strip module adjacent to said third power strip module; and pressing said first reel switch, thereby activating the respective spring-powered reel of said first power module and retracting said first portion of flexible cord, thereby retracting said first power strip module adjacent to said second power strip module.

8. The method of claim 7, further comprising the steps:

activating a first release switch on said first power strip module, said release switch configured to release said first power strip module spring-powered reel, thereby allowing extension of said flexible cord.

9. The method of claim 7, wherein said first power strip module further comprises a surge protector element.

10. The method of claim 7, wherein:

said first power outlet of said first power strip module comprises an American standard power outlet;

said first power outlet of said second power strip module comprises an American standard power outlet; and said first power outlet of said third power strip module comprises an American standard power outlet.

11. The method of claim 7, wherein:

said first power outlet of said first power strip module comprises a European standard power outlet;

said first power outlet of said second power strip module comprises a European standard power outlet; and said first power outlet of said third power strip module comprises a European standard power outlet.

12. The method of claim 7, wherein:

said second power outlet of said first power strip module comprises a universal serial bus (USB) outlet;

said second power outlet of said second power strip module comprises a universal serial bus (USB) outlet; and said second power outlet of said third power strip module comprises a universal serial bus (USB) outlet.

* * * * *